US010497229B2

(12) United States Patent
Bauldree et al.

(10) Patent No.: US 10,497,229 B2
(45) **Date of Patent: *Dec. 3, 2019**

(54) FIRST RESPONSE LOCATOR SYSTEM

(71) Applicant: First Response Locator Systems Inc., Fort Meyers, FL (US)

(72) Inventors: Kenneth Bauldree, Doylestown, PA (US); Angela Glynn, Ft. Meyers, FL (US)

(73) Assignee: First Response Locator Systems of America, LLC, Macon, GA (US)

( * ) Notice: Subject to any disclaimer, the term of this patent is extended or adjusted under 35 U.S.C. 154(b) by 260 days.

This patent is subject to a terminal disclaimer.

(21) Appl. No.: 15/235,493

(22) Filed: Aug. 12, 2016

(65) Prior Publication Data

US 2017/0046926 A1 Feb. 16, 2017

Related U.S. Application Data

(60) Provisional application No. 62/205,477, filed on Aug. 14, 2015.

(51) Int. Cl.
*G08B 7/06* (2006.01)

(52) U.S. Cl.
CPC ..... *G08B 7/064* (2013.01)

(58) Field of Classification Search
CPC ... G06F 3/04842; G08B 26/003; G08B 7/064; G08B 5/36; G08B 21/02; G08B 21/0438; G08B 25/008–016; G01S 5/0009; G01S 19/17; G01S 19/48; H04W 4/22; H04W 4/025; H05B 37/0227–0272; F21Y 2115/10
USPC ..... 340/8.1; 455/404.2
See application file for complete search history.

(56) References Cited

U.S. PATENT DOCUMENTS

| | | | | |
|---|---|---|---|---|
| 7,068,760 | B2 * | 6/2006 | Binning | H04M 11/04 379/45 |
| 9,349,262 | B2 * | 5/2016 | Henrie | G08B 5/38 |
| 9,619,125 | B2 * | 4/2017 | Ruszala | G06F 3/04842 |
| 9,928,702 | B2 * | 3/2018 | Bauldree | G08B 7/064 |
| 2005/0134455 | A1 * | 6/2005 | Binning | G08B 7/064 340/539.18 |
| 2005/0143048 | A1 * | 6/2005 | Binning | H04L 12/66 455/404.2 |
| 2013/0307685 | A1 * | 11/2013 | Sholder | G08B 21/02 340/539.12 |
| 2015/0228176 | A1 * | 8/2015 | Sholder | G08B 21/02 340/539.12 |
| 2016/0063824 | A1 * | 3/2016 | Fiore | G08B 5/38 340/691.8 |
| 2016/0284170 | A1 * | 9/2016 | Kasmir | H04L 12/2818 |
| 2017/0046926 | A1 * | 2/2017 | Bauldree | G08B 7/064 |

* cited by examiner

*Primary Examiner* — Orlando Bousono
(74) *Attorney, Agent, or Firm* — Jason T. Daniel, Esq.; Daniel Law Offices, P.A.

(57) ABSTRACT

A first response locator system includes at least one emergency locator unit having a main body and a lighting unit for generating light in a plurality of different colors. Indicia is disposed along the main body, and a speaker for generating an audible sound is positioned along the main body. An internal controller controls the operation of the speaker and the lighting unit. A remote operation device communicates with the internal controller and includes a plurality of buttons for selectively activating one or both of the lighting unit and the speaker.

6 Claims, 8 Drawing Sheets

FIRST RESPONSE LOCATOR SYSTEM

CROSS-REFERENCE TO RELATED APPLICATIONS

This application claims the benefit of U.S. Application Ser. No. 62/205,477 filed on Aug. 14, 2015, the contents of which are incorporated herein by reference.

TECHNICAL FIELD

The present invention relates generally to life safety devices, and more particularly to a first response locator system that can be selectively activated in an emergency situation.

BACKGROUND

The statements in this section merely provide background information related to the present disclosure and may not constitute prior art.

When emergencies occur within a structure such as a home, apartment, or office building, for example, it is important that a first responder be able to quickly find the individual in distress. Whether the emergency requires the assistance of the police, paramedic/EMS, or the fire department, a few seconds can sometimes mean the difference between life and death.

In recent years, the implementation of GPS navigation systems within first responder vehicles has drastically shortened response times. Although these systems are extremely useful for finding the street or high-rise structure on which the emergency is located, first responders often spend several minutes attempting to locate the correct home or apartment unit. This is especially true at night, where individual house and/or unit numbers may not be sufficiently illuminated.

Within the United States, virtually every home, apartment, condo, and/or business location has a mailbox that is used for sending and receiving mail through the U.S. Postal Service. For detached homes, the mailbox typically includes a freestanding pedestal unit that is located adjacent to the street. Conversely, multi-dwelling units often utilize wall mounted units that are secured to an exterior wall of the building at a location adjacent to the apartment door. In either instance, such mailboxes often display the home or unit number to which it belongs, and it is this address which first responders look for in identifying they have arrived at the correct location.

Accordingly, it would be beneficial to provide a first response locator system that can function alone or in conjunction with a mailbox to provide a conspicuous visual indication of the location of an emergency to first responders.

SUMMARY OF THE INVENTION

The present invention is directed to a first response locator system. One embodiment of the present invention can include at least one emergency locator unit which can be positioned at a conspicuous outdoor location such as at a mailbox or a building wall. Each of the locator units can include a lighting unit having at least one lighting element which can generate light in a plurality of different colors such as red, blue, and green, for example. Each of the locator units can also include a speaker for generating an audible sound. The lighting unit and speaker can be controlled by an internal controller having a communication unit that is capable of receiving operating instructions from an external device.

Another embodiment of the present invention can include a remote operation device that can communicate with the internal controller to selectively activate one or both of the lighting unit and the speaker. The remote operation device can be constructed as a portable unit that is small enough to fit in the pocket of clothing, or can be permanently affixed within a structure. The remote operation device can include a plurality of buttons which can be selectively activated to correspond to a fire, medical or police emergency.

In yet another embodiment of the present invention, the main body can be adapted for use with an existing mailbox or other outdoor structure and can include a mounting bracket for securement thereto.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
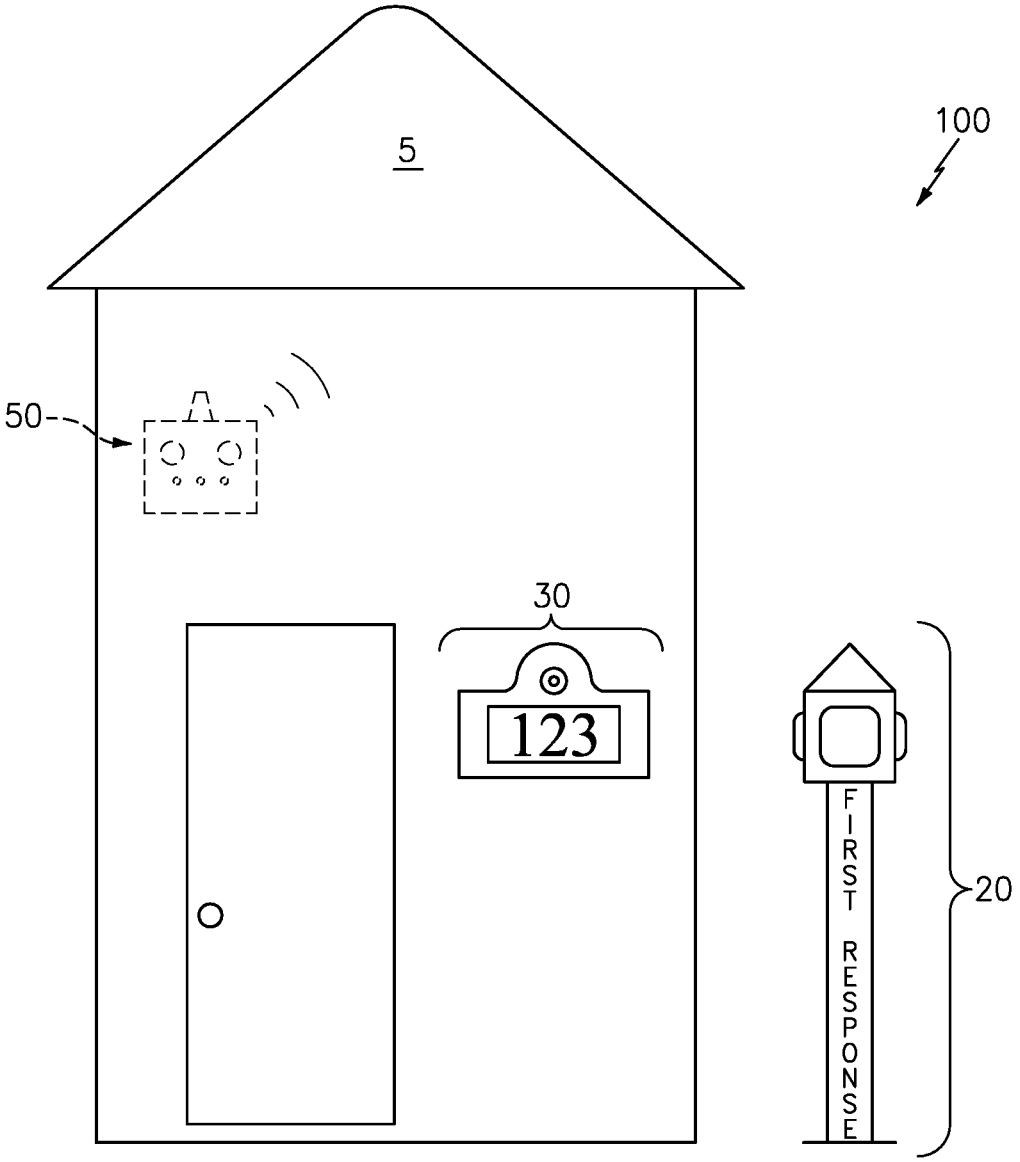
FIG. 1 is an exemplary operating environment of a first response locator system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 illustrates one embodiment of the first response locator system 100 for assisting first responders to locate a particular building or residence 5. As shown, the system can include a one or both of a freestanding emergency locator unit 20, and a compact emergency locator unit 30, that are in communication with a remote operation device 50.

Figure 2A:
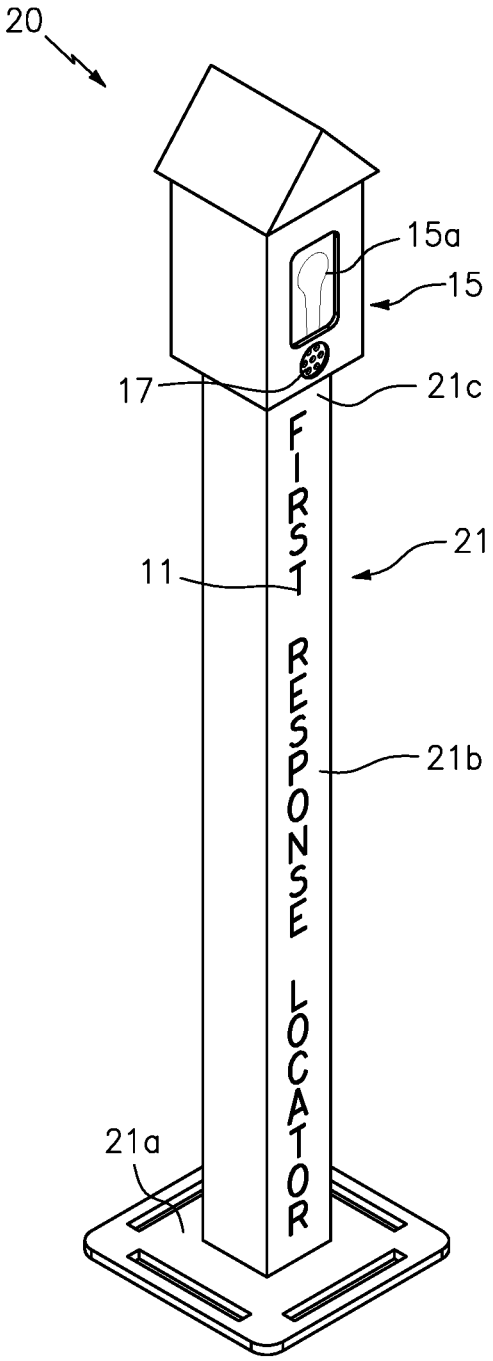
FIG. 2A is a front side view of a freestanding emergency locator unit of the system, in accordance with one embodiment of the invention.

FIG. 2A, illustrates one embodiment of a freestanding emergency locator unit 20 that includes an elongated main body 21 having a bottom end 21*a* for engaging the ground, a middle section 21*b* and a top end 21*c*. The main body can include any number of different shapes and sizes, and can function to house the below described internal controller 40. As such, the main body can be constructed from any number of different materials that are suitable for prolonged use in an outdoor environment (i.e., weather resistant), such as various metals, plastics and/or composites, for example.

Figure 2B:
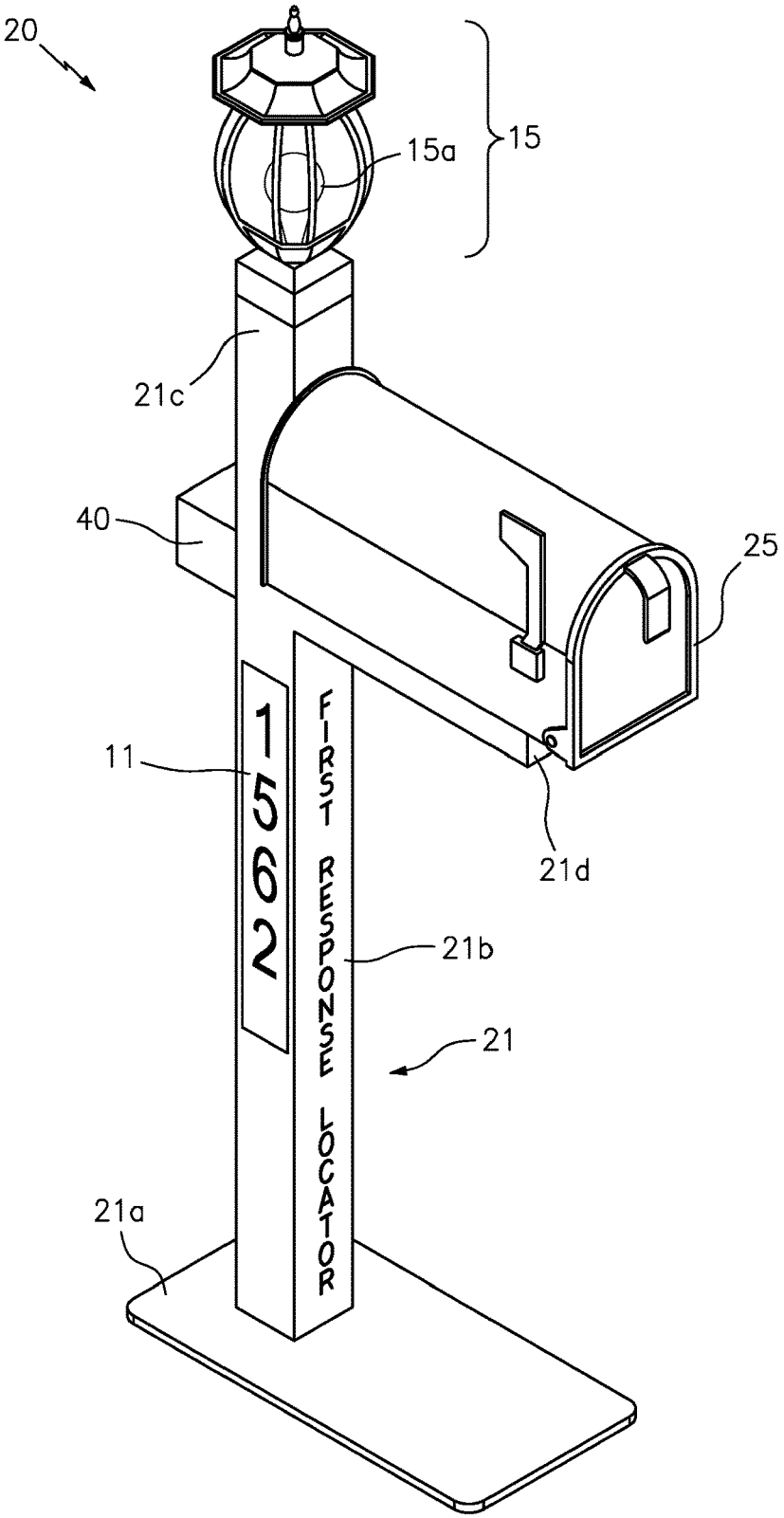
FIG. 2B is a perspective view of another freestanding emergency locator unit of the system, in accordance with one embodiment of the invention.

As shown in FIG. 2B, the freestanding main body 21 can also include a generally horizontal arm 21*d* onto which a mailbox 25 can be secured. In various embodiments, the horizontal arm can be positioned so as to ensure the height of the mailbox 25 from the ground is in compliance with any applicable laws and/or ordinances. Such a feature is particularly advantageous for new construction projects wherein the lifesaving benefits of the first response locator system can be seamlessly incorporated into the design of a new mailbox and can be deployed uniformly across an entire subdivision.

In either instance, the locator unit 20 can also include any type of indicia 11, such as the building address, and/or emergency identification information, which clearly describe the purpose for the device to which the indicia is attached. Of course, the term "indicia" can also include any type of decorative and/or functional elements such as various colors, markings, words, shapes, symbols, logos, designs, lights, types of materials, texturing of materials, patterns, images, lithographs, and/or photographs, for example. The indicia can be secured onto and/or into the main body in accordance with known techniques so as to be flush with the surface of the main body or can be raised/protruding outward from the main body so as to give a three dimensional effect.

A lighting unit 15 can be provided along the main body in order to provide a clear visual indication of the location of an emergency. As shown, the lighting unit of the freestanding locator unit 20 can preferably include a decorative shape that can be positioned at the top end of the main body 21*c*, so as disburse a bright beam of light in a 360 degree field of view. Of course, the lighting unit 15 is not to be construed as limited to the illustrated shape or location along the associated main body, as the lighting unit can include any shape, any size and can be secured along any location of the main body (See FIGS. 3A and 3B).

In either instance, the lighting unit 15 can function to house any number of different lighting elements 15*a*, such as one or more light emitting diodes (LED), for example. Of course the lighting unit is not limited to the use of LED's, as any type and number of light producing element(s) can be utilized herein. Several nonlimiting examples include compact fluorescent, incandescent, and/or halogen, for example.

As will be described below, the lighting unit 15 can be controlled by the internal controller 40 and can be selectively activated via the remote operation device 50. In the preferred embodiment, the lighting elements 15*a* will be configured to generate red, green and blue light. Of course, the lighting unit can function to generate continuous and/or bursts of light in any number of different colors, intensities and/or durations.

In various embodiments, one or more speakers 17 can also be provided along the main body and/or the lighting unit 15. Each of the speakers can function to play an audible sound such as an alarm tone and/or a pre-recorded message, for example, based on an instruction from the internal controller 40 and the remote operation device 50.

Figure 3A:
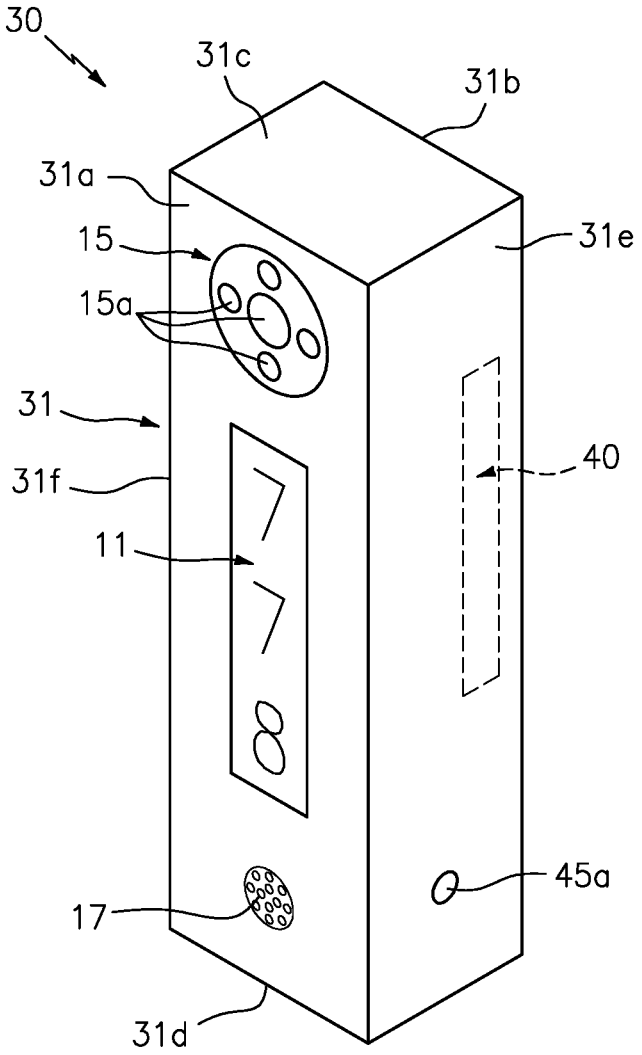
FIG. 3A is a perspective view of a compact emergency locator unit of the system, in accordance with one embodiment of the invention.
Figure 3B:
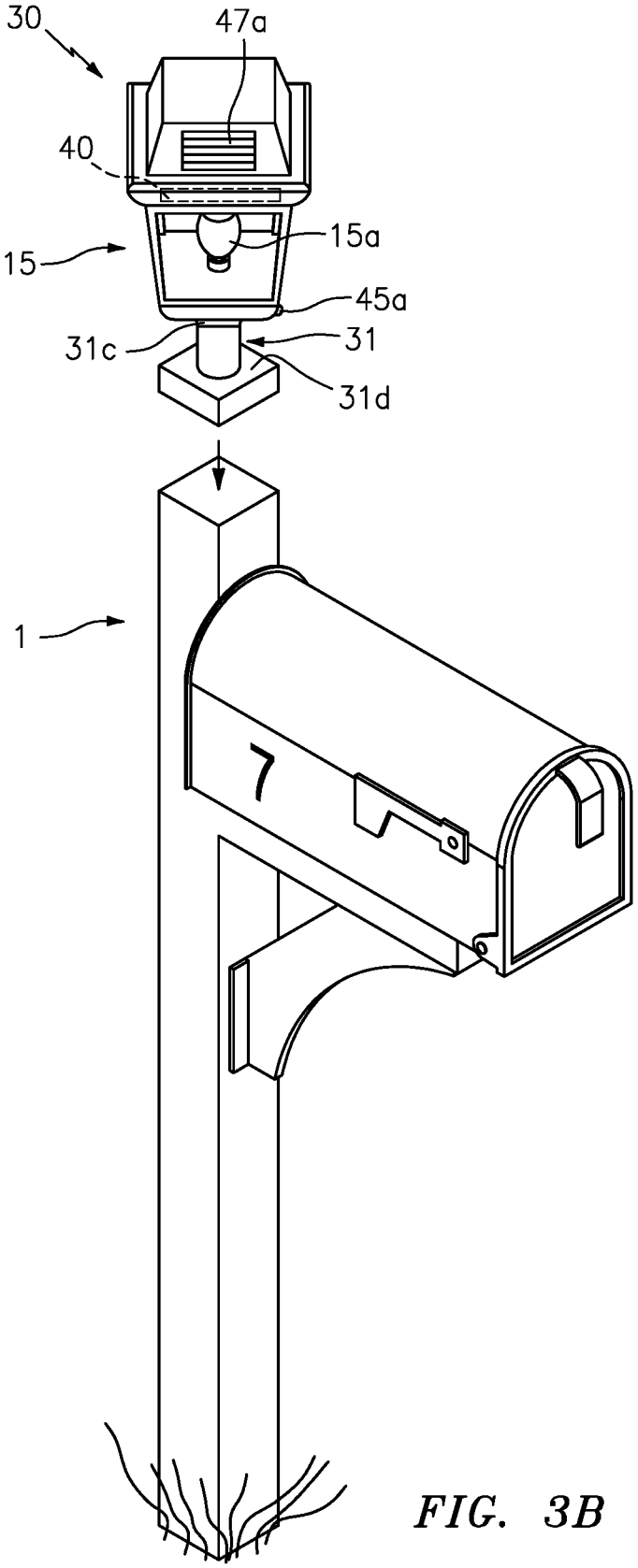
FIG. 3B is a perspective view of another compact emergency locator unit of the system, in accordance with one embodiment of the invention.

FIGS. 3A and 3B illustrate various embodiments of a compact emergency locator unit 30, which can be used at locations such as apartment buildings, for example, where it is not possible to utilize a freestanding unit 20. The compact locator unit 30 can also be secured onto other structures such as an existing mailbox, for example, so as to allow the same to be retrofitted with the lifesaving features provided by the first response locator system.

As shown, the compact emergency locator unit 30 can include a main body 31 having a front surface 31*a*, a back surface 31*b* a top surface 31*c*, a bottom surface 31*d* and a pair of opposing side surfaces 31*e* and 31*f* that define a generally hollow interior space for housing the below described internal controller 40.

The main body 31 can include an unlimited number of different and/or decorative shapes and sizes such as square, oval, or rectangular, for example, and can also be constructed from any number of different materials that are suitable for prolonged use in an outdoor environment, such as various metals, plastics and/or composites, for example.

As shown in FIG. 3A, one embodiment of the compact locator unit 30 can include a generally flat back surface 31*b* so as to allow the unit to include or be fitted with any type of mounting hardware and/or brackets (not illustrated). Such a feature allows the device 30 to be secured onto a secondary object such as an office/apartment building wall, for example.

In the present embodiment, the lighting unit 15 can include a non-decorative shape having a generally flat front surface that is positioned along the main body 31 so as to allow the lighting elements 15*a* to disburse the generated light outward from the front surface thereof. Likewise, the speaker 17 and indicia 11 can be provided along the front surface of the main body. Of course, the unit 30 is not limited to the illustrated shape or arrangement of components, as many different modifications to the same are also contemplated.

For example, FIG. 3B illustrates one embodiment of a compact emergency locator unit 30 that includes a decorative lighting unit 15 that extends upward from the top surface 31*c* of the main body. In the present example, the bottom surface 31*d* can be generally flat, so as to allow the unit to include or be fitted with a post bracket 35, or other such mounting hardware. Such a feature allows the device 30 to be secured onto the top of an existing mailbox 1 or other such structure, for example.

Figure 4:
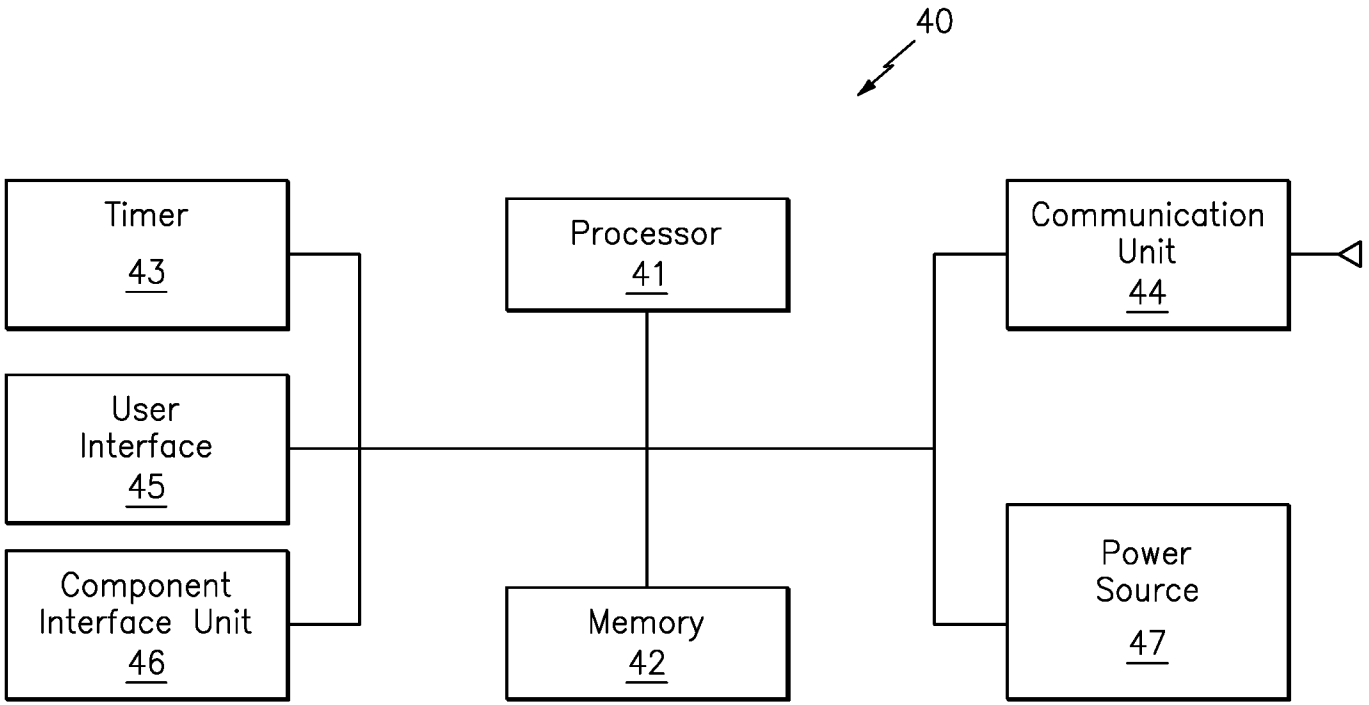
FIG. 4 is a simplified block diagram of the internal controller of the emergency locator unit, in accordance with one embodiment of the invention.

FIG. 4 is an exemplary block diagram of an internal controller 40 which can be provided within the main body and/or lighting unit of the locator units 20 and 30. As shown, the internal controller 40 can include any number of components such as a processor 41 that is conventionally connected to an internal memory 42, a timer module 43, a communication unit 44, a user interface 45, a component interface unit 46, and/or a power source 47.

The processor/CPU 41 can act to execute program code stored in the memory 42 in order to allow the device to perform the functionality described herein. Likewise, a timer module 43 can be provided, and can function to accurately measure the passage of time. As described herein, the timer module can be provided as a function of the processor or can include a separate physical circuit. In either instance, processors and timers are extremely well known in the art, therefore no further description will be provided.

Memory 42 can act to store operating instructions in the form of program code for the processor 41 to execute. Although illustrated in FIG. 4 as a single component, memory 42 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device such as a hard drive, for example. Additionally, memory 42 can also include one or more cache memories that provide temporary storage of at least some program code in order to reduce the number of times program code must be retrieved from the bulk storage device during execution. Each of these devices are well known in the art.

The communication unit 44 can function to provide wired or wireless communication between the internal controller 40 and an external device. For example, the communication unit 44 can include a variable radio wave transceiver which can send and receive information wirelessly with the below described remote operation device 50. Alternatively, or in addition thereto, the communication unit 44 can include a Bluetooth transceiver for communicating wirelessly with a portable user device such as a smartphone that is running a First Response Locator App, for example. Of course, any number of other known transmission and reception mechanisms and protocols can also be utilized herein. Several nonlimiting examples include unique radio frequencies, infrared (IR), RFID, and/or a network adapter functioning to communicate over a WAN, LAN or the internet via an internet service provider, for example.

The user interface 45 can function to accept user inputs for instructing device operation. As such, the user interface can include or control one or more buttons/switches 45*a* that are connected to the processor 41 so as to activate various programmatic functions, such as pairing the unit with an external device and/or transitioning the device between an ON and OFF operating state, for example.

The component interface unit 46 can function to provide a communicative link between the processor 41 and various other device components such as the above described lighting unit 15 and/or speaker 17, for example. In this regard, the component interface unit can include any number of different components such as one or more PIC microcontrollers, internal bus, USB connections and other such hardware capable of providing a direct link between the various components. Of course any other means for providing the two way communication between the identified components can also be utilized herein.

The power source 47 can include any number of different components capable of providing the necessary power requirements to each element of the locator unit. To this end, the power source can include or comprise any number of different batteries and/or can include a common A/C electrical power transformer and cord capable of allowing the locator unit to be powered from an electrical outlet. In various embodiments, the power source can also include one or more solar panels 47*a* which can use the sun to power the device.

Figure 5A:
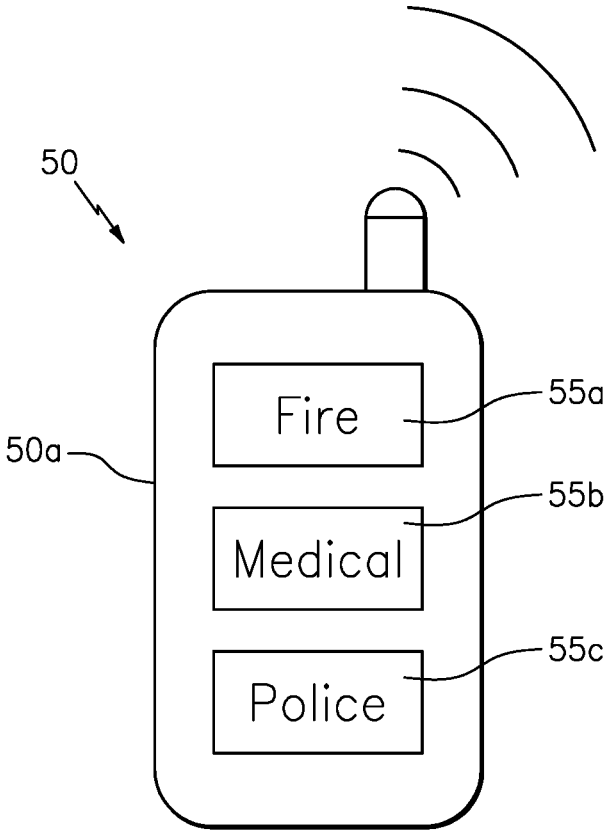
FIG. 5A is a perspective view of the remote operation device of the system, in accordance with one embodiment of the invention.
Figure 5B:
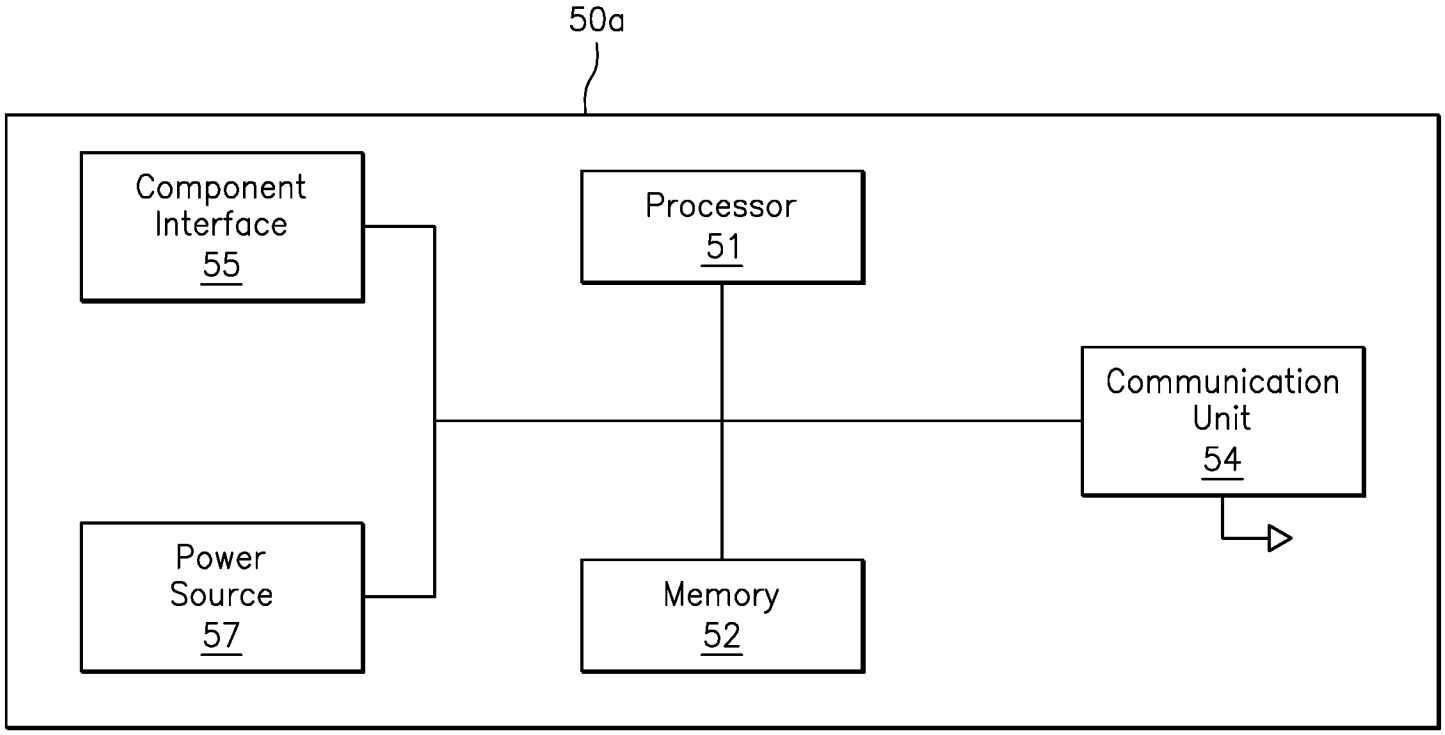
FIG. 5B is a simplified block diagram of the internal components of the remote operation device of the system, in accordance with one embodiment of the invention.

The system 100 can include any number of distinct remote operation devices 50 which can function to selectively activate one or more of the above described emergency locator units. To this end, FIGS. 5A and 5B illustrate one nonlimiting embodiment of a remote operation device 50. As shown, the device can include a main body 50*a* which houses an internal processor 51, memory 52, communication unit 54, user interface 55 and power source 57. Each of the components 51, 52, 54, 55 and 57 being identical in form and function to those described above with respect to components 41, 42, 44, 45 and 47, respectively, therefore a duplicate description is not provided.

The main body 50*a* can include any number of different shapes and sizes, and can be constructed from any number of different materials such as plastic, for example. The main body can be constructed so as to be portable in nature (e.g., pendant or keychain), or can be affixed to stationary location in a manner similar to an alarm control panel, for example.

In either instance, the device 50 can include a plurality of user interface components, such as the illustrated buttons, for example, that can be provided at any location along the main body 50*a*. Each of the buttons can function to selectively activate the lighting unit 15 and/or speaker 17 of an emergency locator unit to which the remote operation device is programmed to communicate with.

In one nonlimiting example, the remote operation device 50 can include a first button 55*a* which can be selectively engaged by a user to transmit a first signal to the internal controller 40 of an emergency locator unit 20 and/or 30. Upon receiving the first signal, the lighting unit 15 can immediately begin to flash red light, so as to assist firefighters in locating the building or residence at which a fire is occurring.

In another nonlimiting example, the remote operation device 50 can include a second button 55*b* which can be selectively engaged by a user to transmit a second signal to the internal controller 40 of a particular location unit 20 and/or 30. In the present example, receipt of this second signal can cause the lighting unit 15 to flash blue light, so as to assist EMS responders in locating the building or residence at which a medical emergency is occurring.

In yet another nonlimiting example, the remote operation device 50 can include a third button 55*c* which can be selectively engaged by a user to transmit a third signal to the internal controller 40 of a particular location unit 20 and/or 30. In the present example, receipt of this third signal can cause the speaker 17 to produce an alarm, and can cause the lighting unit 15 to flash red and blue light, so as to assist police in locating the building or residence at which help is needed.

The lighting unit and/or speakers in the above described examples can be programmed to operate only for a predetermined period of time, such as 30 minutes, for example, utilizing the internal timer, or can continue to operate until the respective button has been pressed again, thereby deactivating the operation of the locator unit.

Of course, these are but three nonlimiting examples of the functionality which can be employed by the system 100. As such, those of skill in the art will recognize that any number of different programmatic instructions can be sent and received between the respective devices in order to utilize the functionality of the individual location units. For example, the system can further include functionality for automatically activating the lighting unit between dusk and dawn, when no emergency is occurring. When so activated, the light will preferably include a soft white hew which can illuminate the device and deter criminal activity nearby.

Accordingly, the above described first response locator system can function to provide an immediate visual indication of the location of an emergency, which can be viewed from great distances by a first responder.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A first response locator unit, comprising:

an elongated freestanding main body having a top end, a bottom end, and a middle section;

a lighting unit that is positioned along the top end of the main body;

at least one lighting element that is positioned within the lighting unit;

an internal controller that is in communication with the lighting unit, said internal controller including a communication unit for communicating with an external device;

an arm that extends outward from the freestanding main body at a generally perpendicular angle; and a mailbox that is disposed along the arm.

2. The system of claim 1, further comprising:

a speaker that is in communication with the internal controller.

3. The system of claim 2, further comprising:

at least one user input member that corresponds to a request for assistance, each of the at least one user input members being disposed along the main body and functioning to selectively activate each of the speaker and the lighting unit.

4. The system of claim 1, further comprising:

at least one piece of indicia that is secured along the main body, said indicia including emergency information.

5. The system of claim 1, wherein the at least one lighting element includes one or more light emitting diodes that are configured to generate light at a plurality of different colors.

6. The system of claim 1, wherein the lighting unit is removably connected to the main body.

* * * * *